US005275691A

United States Patent [19]

Fukuta et al.

[11] Patent Number: 5,275,691

[45] Date of Patent: Jan. 4, 1994

[54] METHOD FOR TREATING A SURFACE OF AN ALUMINUM SUBSTRATE FOR A PRINTING PLATE

[75] Inventors: Hiroshi Fukuta; Akio Uesugi, both of Shizuoka, Japan

[73] Assignee: Fuji Photo Film Co., Ltd., Kanagawa, Japan

[21] Appl. No.: 834,358

[22] Filed: Feb. 12, 1992

[30] Foreign Application Priority Data

| | | | |
|---|---|---|---|
| Feb. 28, 1991 | [JP] | Japan | 3-055637 |
| Apr. 9, 1991 | [JP] | Japan | 3-103356 |
| Jun. 20, 1991 | [JP] | Japan | 3-174835 |
| Jul. 12, 1991 | [JP] | Japan | 3-197307 |

[51] Int. Cl.[5] ..... C23D 1/00

[52] U.S. Cl. ..... 156/642; 156/665; 156/345; 210/711; 210/724; 210/737

[58] Field of Search ..... 156/642, 665, 345; 210/711, 724, 737

[56] References Cited

U.S. PATENT DOCUMENTS

| | | | |
|---|---|---|---|
| 3,890,226 | 6/1975 | Hanami et al. | 423/629 X |
| 3,909,405 | 9/1975 | Aoyama . | |
| 4,136,026 | 1/1979 | Meyer et al. . | |
| 4,372,805 | 2/1983 | Takahashi et al. | 156/642 |
| 4,826,605 | 5/1989 | Doble et al. . | |
| 5,049,233 | 9/1991 | Davis | 156/642 |

*Primary Examiner*—Thi Dang

*Attorney, Agent, or Firm*—Sughrue, Mion, Zinn, Macpeak & Seas

[57] ABSTRACT

A method and apparatus for treating a surface of an aluminum substrate for a printing plate includes treating the substrate surface with a treatment liquid being circulated, separating and discharging aluminum ions from a portion of the treatment liquid, recovering a sodium hydroxide solution from the treatment liquid, mixing the recovered sodium hydroxide solution with the treatment liquid being circulated, and maintaining a predetermined concentration of aluminum ions in the treatment liquid to be used. A portion of the treatment liquid containing sodium aluminate solution is mixed with aluminum slag containing an amorphous aluminum hydroxide produced at the time of neutralization of a waste acid and a waste alkali produced during surface treatment to thereby supersaturate the sodium aluminate solution, crystallize the aluminum hydroxide, and recover the sodium hydroxide solution to be returned to a liquid control tank to maintain a predetermined concentration of aluminum ions in the treatment liquid. Further, the characteristics of the aluminum slag are changed to be usable as an industrially available aluminum hydroxide. Still further, a hydrolytic reaction is caused in a separated part of the treatment liquid. Preferably, the supersaturated aluminate solution is passed through a filter, so that aluminum hydroxide is crystallized from the sodium aluminate solution, and the sodium hydroxide solution is recovered.

24 Claims, 6 Drawing Sheets

METHOD FOR TREATING A SURFACE OF AN ALUMINUM SUBSTRATE FOR A PRINTING PLATE

BACKGROUND OF THE INVENTION

The present invention relates to a method for performing surface treatment of an aluminum plate used for a printing plate, and particularly relates to a method for recovering an etching liquid containing sodium hydroxide as a main component thereof and a method for improving the quality of aluminum slag generated in the surface treatment.

Various treatment liquids are used in performing surface treatment of an aluminum plate for a printing plate. For example, nitric acid and hydrochloric acid are used in an electrical surface-roughening process, sulfuric acid is used in an anodizing process, and aluminum hydroxide is generally used in a process of etching aluminum chemically.

On the other hand, as a support or substrate for a lithographic press plate, an aluminum plate or an aluminum alloy plate is used, and the surface shape or the like of the substrate after being treated varies largely depending on the concentration of aluminum ions in the above-mentioned treatment liquid, so that the aluminum ions greatly affect the quality of a plate used for a printing plate.

For example, when electrochemically roughening an aluminum plate with nitric acid, the concentration of nitric acid is preferably selected to have a value ranging from 5 grams/liter to 30 grams/liter to perform uniform roughening, and the concentration of the aluminum ions is preferably selected to have a value ranging approximately from 5 grams/liter to 15 grams/liter.

Additionally, when performing an anodizing treatment with sulfuric acid, the concentration of sulfuric acid preferably ranges from 50 grams/liter to 300 grams/liter. If the concentration of the aluminum ions exceeds 15 grams/liter, an anodized film cannot be produced uniformly on the aluminum plate surface.

Generally, an etching treatment using sodium hydroxide is performed as a process after roughening the surface mechanically or before or after roughening the surface with nitric acid or sulfuric acid electrochemically. In most cases, aluminum ions exist in a treatment liquid. Thus, the optimum values of the respective concentrations of the sodium hydroxide and aluminum ions range from 200 to 600 grams/liter, which is not more than the saturation concentration, and from 10 to 100 grams/liter. Additionally, the ratio of the aluminum ion concentration to the sodium hydroxide concentration is low, and generally the concentration of aluminum ions is made no higher than the saturation concentration.

As described above, the aluminum ion concentration greatly influences the quality of an aluminum substrate used for a printing plate, and hence maintaining the proper aluminum ion concentration in the treatment liquid to a predetermined value is critical. To maintain the concentration of aluminum constant, the treatment liquid in the treatment system has generally been discharged externally of the system, or, as disclosed in Japanese Unexamined Patent Publication No. Sho-57-192300, the aluminum ions in a treatment liquid have been absorbed by an ion-exchange resin.

However, in the method for discharging the treatment liquid in a treatment system externally of the system to adjust the concentration of aluminum ions, treatment liquid must be discharged together with the aluminum ions, so that the quantity of the treatment liquid used becomes very large and the amount of waste treatment liquid is also large.

In the method for absorbing aluminum ions with an ion-exchange resin to discharge the aluminum ions externally of a system, the ratio of removing the aluminum ions relative to the amount of ion-exchange resin used is so low that a large quantity of resin must be used. Furthermore, the resin must be exchanged frequently, for instance, every three months, and thus the operating costs of the system are high.

Additionally, the present applicants have earlier proposed (see Japanese Unexamined Patent Publication No. Hei-1-200992) a method of discharging aluminum ions externally of a system through diffusion dialysis using an ion-exchange resin to separate aluminum ions from sodium hydroxide. However, in diffusion dialysis, aluminum hydroxide scale and the like tends to adhere to the waste liquid side after removal of undissolved metal such as iron adhering to a film. Thus, after the diffusion dialysis, an acid such as sulfuric acid must be used to clean the system, for instance, every three days, thereby increasing the cost of using such a system. Additionally, a large amount of aluminum slag is discharged during the surface treatment process of an aluminum plate, and there has not been any commercial use of this slag, so that managing and disposing of the slag is burdensome.

Additionally, in accordance with a technique disclosed in Japanese Examined Patent Publication No. Sho-57-2649, a silicic acid is added, but applications of this technique are limited, and the technique is not preferably used for the surface treatment of a substrate for a lithographic press plate.

In view of the foregoing conventional methods, when performing surface treatment of an aluminum plate for a lithographic press plate using various alkali treatment liquids, and particularly when performing a surface etching treatment using sodium hydroxide, it has been difficult to maintain the concentration of aluminum ions in a treatment system to a predetermined value to make the quality of the treated surface superior and uniform. Additionally, it has been difficult from the standpoint of environmental integrity and operating costs to reuse the large amount of aluminum slag discharged during the surface treatment process. However, as described above, no suitable method has yet been proposed.

Another problem that the invention is directed to solving is to accelerate the crystallizing reaction of the etching liquid and the aluminum hydroxide and to reduce impurities contained in the aluminum hydroxide changed in quality when the liquid in which the above-mentioned aluminum slag is dissolved is crystallized and the aluminum slag is changed in quality.

Thus, the conventional methods and apparatus for performing surface treatment of an aluminum plate for a lithographic printing plate using various alkali treatment liquids, and particularly surface etching using sodium hydroxide, are inadequate to: maintain a predetermined concentration of aluminum ions in a treatment liquid (etching liquid) in a treatment system to make the quality of the treated surface superior and uniform, industrially reuse the aluminum hydroxide recovered from the etching liquid, and accelerate the crystallizing reaction to recover the etching liquid, and reduce impurities contained in the recovered aluminum hydroxide.

However, as has been described above, no acceptable method therefor has been conventionally proposed.

SUMMARY OF THE INVENTION

In view of the foregoing problems of the conventional systems and methods, an object of the present invention is to maintain the concentration of aluminum ions in a treatment liquid to a predetermined value to make the quality of the treated surface superior and uniform when performing surface treatment on an aluminum plate for a printing plate by using sodium hydroxide.

Another object of the present invention is to industrially and effectively reuse aluminum slag discharged during a surface treatment process.

Yet another object of the present invention is to reduce impurities contained in the aluminum slag discharged in a surface treatment process to thereby improve the quality of the aluminum slag so that the slag can be reused. With the above objects in mind, the present invention has been developed.

According to a first embodiment of the present invention, aluminum slag, which contains, as its main component, an amorphous aluminum hydroxide produced during neutralization of a waste acid and a waste alkali produced in a surface treatment process of an aluminum plate, is mixed with a portion of the treatment liquid containing the sodium aluminate solution while the latter is circulated to thereby supersaturate the sodium aluminate solution, crystallize the aluminum hydroxide, and recover the sodium hydroxide solution. The recovered sodium hydroxide solution is returned to a liquid control tank so that the concentration of aluminum ions in the treatment liquid can be maintained at a predetermined value, and the aluminum slag, which prior to the invention was an industrial waste, is used as an industrially available aluminum hydroxide, thereby eliminating industrial waste.

In the present invention, the separation of the aluminum ions in the treatment liquid externally of the system refers to the separation of the treatment liquid used in the treatment process externally of the system at a position independent of the treatment process.

Further, mixing the recovered treatment liquid with the treatment liquid while the latter is being circulated and maintaining a constant value of the aluminum ion concentration in the treatment liquid means that recovered liquid having a small quantity of aluminum ions is returned to the liquid control tank and a make-up liquid and dilution water are added to thereby maintain the concentration of aluminum ions in the treatment liquid at a predetermined value.

In a diffusion dialysis method using an ion-exchange film, separation is performed using the concentration difference between liquids on the opposite sides of the ion-exchange film.

As a method for crystallizing aluminum hydroxide by using a saturated sodium aluminate solution, there are various methods, including a method for separating aluminum hydroxide by using an agitating blade, as disclosed in Japanese Examined Patent Publication No. Sho-53-27718.

Further, to achieve the above objects and solve the foregoing problems, in accordance with a second embodiment of the present invention, a portion of a treatment liquid containing a sodium aluminate solution used while being circulated is extracted so that a hydrolytic reaction is caused by adding water thereto, if necessary, to crystallize aluminum hydroxide from the sodium aluminate solution and to recover the sodium aluminate solution simultaneously. Then, the recovered sodium hydroxide solution is returned to a liquid control tank (and condensed if necessary). Thus, the concentration of aluminum ions in the treatment liquid system may be maintained at a predetermined value, and an industrially useful form of aluminum hydroxide may be produced.

According to a third embodiment of the present invention, after aluminum slag, which contains, as its main component, amorphous aluminum hydroxide produced during neutralization of waste acid and waste alkali produced in a surface treatment process of an aluminum plate, is mixed with a portion of the treatment liquid containing the sodium aluminate solution used while being circulated, and the dissolved solution is passed through a filter so that undissolved components in the solution are eliminated. The resulting liquid, which has been turned into a supersaturated sodium aluminate solution, is fed to a crystallizing tank, and aluminum hydroxide is crystallized so that the aluminum slag, which prior to the present invention has been an industrial waste, is changed into crystallized aluminum hydroxide having a low content of water, which can be used as an industrially effective aluminum hydroxide. Thus, a surface treatment method according to the invention is preferable over those of the conventional methods.

A fourth embodiment according to the present invention includes a method for performing surface treatment on an aluminum substrate for a printing plate comprising the steps of separating, externally to a system, aluminum ions from a portion of treatment liquid containing a sodium aluminate solution used while being circulated for surface etching treatment, recovering a sodium hydroxide solution, mixing the recovered sodium hydroxide with the treatment liquid used while being circulated, and maintaining the concentration of aluminum ions in said treatment liquid at a predetermined value.

After separation by either mixing a portion of a treatment liquid containing a sodium aluminate solution used while being circulated with a proper quantity of water, or extracting a portion of a treatment liquid containing a sodium aluminate solution used while being circulated, a hydrolytic reaction is produced in the separated portion of the treatment liquid so that the aluminum hydroxide is crystallized from the sodium aluminate solution, and simultaneously the sodium hydroxide solution is recovered to be reused. Then, the recovered sodium hydroxide solution is returned to a liquid control tank (and condensed if necessary). Thus, the concentration of aluminum ions in the treatment liquid system may be maintained at a predetermined value, and industrially useful aluminum hydroxide can be produced.

Additionally, after a portion of the liquid is extracted from the treatment liquid containing a sodium aluminate solution used while being circulated as described above, or a liquid mixture of the above-mentioned liquid portion with a desired quantity of water is passed through a filter, a hydrolytic reaction is produced so that aluminum hydroxide is crystallized from the sodium aluminate solution, and the sodium hydroxide solution is recovered to be reused. Preferably, the recovered sodium hydroxide solution is returned to a liquid control tank (and condensed if necessary at this time). Thus, it is possible to maintain a predetermined concentration of aluminum ions in the treatment liquid system, and industrially useful aluminum hydroxide may be produced having less impurities than the above-mentioned case.

DESCRIPTION OF THE PREFERRED EMBODIMENTS

A first embodiment of the present invention will be described with reference to FIGS. 1 and 2. However, the present invention is not to be limited by this or any other embodiment described below.

Figure 1:
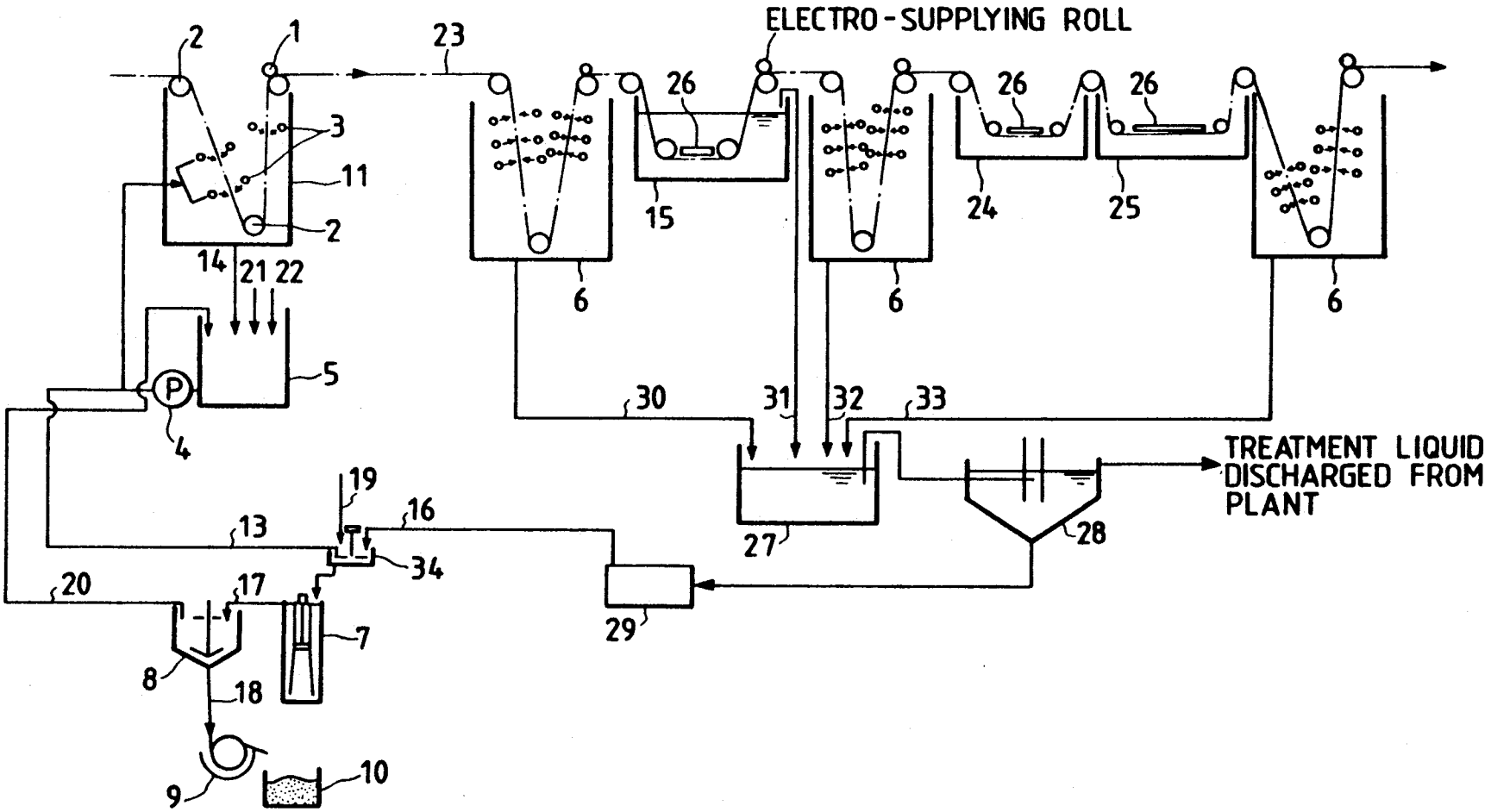
FIG. 1 shows schematically the configuration of an apparatus for performing etching treatment according to a first embodiment of the present invention.
Figure 2:
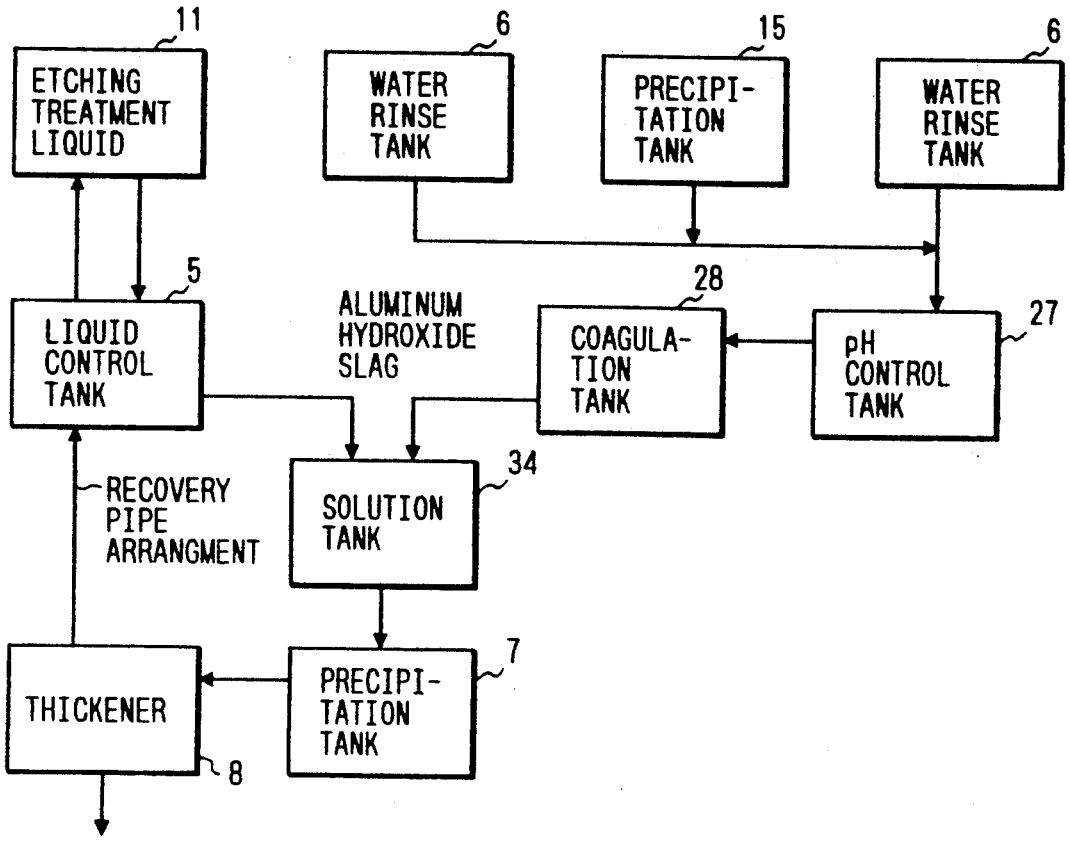
FIG. 2 is a flow diagram of the schematic configuration shown in FIG. 1.

FIGS. 1 and 2 are, respectively, a schematic configuration diagram and a flow diagram of an apparatus for performing surface treatment of an aluminum plate according to the method of the first embodiment of the present invention.

In the etching treatment, an aluminum plate 23 is conveyed through a series of rollers 2 through an etching treatment tank 11, a water rinse tank 6, an electrolytic treatment tank 15 having an electrode 26, a second water rinse tank 6, an anodizing power supply tank 24 having an electrode 26, an anodizing tank 25 having an electrode 26, and a third water rinse tank 6. A treatment liquid is mixed in a liquid control tank 5, and the mixed treatment liquid is fed to a spray pipe 3 in an etching treatment tank 11 through a liquid feed pipe 12 by using a liquid feed pump 4. The etching treatment liquid from the liquid control tank 5 may also be fed to a dissolution tank 34 through a liquid feed pipe 13 branching off from the liquid feed pipe 12. The quantity and time of the fed liquid can be controlled by valves (not shown in the drawings) provided in line with the pipe arrangements.

The liquid control tank 5 and the etching treatment tank 11 are interconnected through the liquid feed pipe 12 and a return liquid pipe 14, and the etching treatment liquid is circulated among them. Through the etching treatment, the quantity and component concentration of the treatment liquid are changed. For example, a sodium hydroxide component in the treatment liquid decreases by a reaction caused during the etching treatment, the quantity of an aluminum ion component increases, water decreases by evaporation, and so on. Therefore, the sodium hydroxide solution and water used in the treatment liquid in the liquid control tank 5 are replenished through make-up or replenishing pipes 21 and 22, respectively. However, it is not very effective to maintain a predetermined concentration of the aluminum ions in the treatment liquid by using a make-up liquid without also eliminating the increase of aluminum ions.

Therefore, a portion of the treatment liquid which is used while being circulated in the liquid control tank 5 is fed to the dissolution tank 34 through the liquid feed pipe 13 occasionally so that aluminum ions are discharged externally of the system. On the other hand, a waste alkali 30 and a waste acid 31-33 discharged as a result of the surface treatment are neutralized in a pH control tank 27 so that aluminum slag 16 is coagulated in a coagulation tank 28. After solid and liquid phases are separated in a filter press 29, the aluminum slag 16 is fed to the dissolution tank 34 occasionally.

In the dissolution tank 34, the etching treatment liquid and the aluminum slag 16 are mixed and adjusted into a supersaturated sodium aluminate solution, which is fed to a precipitation tank 7 occasionally. In the precipitation tank 7, the aluminum hydroxide is crystallized by using a seed of aluminum hydroxide in the supersaturated sodium aluminate solution as a nucleus.

Thereafter, the mixture of the treatment liquid mainly including a sodium hydroxide solution having a reduced concentration of aluminum ions and the crystals of aluminum hydroxide is fed to a thickener 8 through a liquid feed pipe 17. The crystallized aluminum hydroxide is separated in a drum filter 9 through a pipe 18, and collected into a hopper 10. On the other hand, the treatment liquid mainly including a sodium hydroxide solution is returned, as a recovered liquid, to the liquid control tank 5 through a recovery pipe 20.

According to the apparatus having the above-mentioned arrangement, the quantity of the treatment liquid used per unit time when performing an etching treatment on the surface of an aluminum plate was measured while the treatment liquid was recovered under the following conditions:

| | |
|---|---|
| aluminum plate width | 1000 mm |
| treatment speed | 50 meters/minute |
| treatment liquid: | |
| sodium hydroxide | 300 grams/liter |
| aluminum ions | 75 gram/liter |
| temperature | 60° C. |

The quantity of the sodium hydroxide solution recovered from the make-up pipe 22 was 60 kilograms/hour (20 grams/square meter).

The time required for crystal separation reaction in the precipitation tank 7 was about 60 hours, and the aluminum hydroxide obtained by crystallization had the following qualities:

| | |
|---|---|
| iron component | 360 mg/kg |
| silicon dioxide | 50 mg/kg |
| $COD_{Cr}$ | 540 mgo/kg |
| content of water | 11.4% |
| color | light brown |

COMPARATIVE EXAMPLE NO. 1

Similarly to the conventional methods, etching treatment was performed on the surface of an aluminum plate by a method $ of external control to maintain the aluminum ion concentration constant while omitting the processes subsequent to the solution tank, and discharging a portion of the surface treatment liquid externally of the system. Other conditions were the same as in the first embodiment described above.

The quantity of the sodium hydroxide solution used per unit time was greatly increased to 240 kilograms/-hour (80 grams/square meter). Additionally, it was necessary to treat the surface treatment liquid discharged externally of the system by neutralization or the like, and it was necessary to dispose of the aluminum hydroxide slag discharged in the respective surface treatment processes.

Thus, as compared to the conventional methods, the surface treatment method according to the present invention has the following advantages:

(1) the efficiency of using the treatment liquid utilized for surface treatment was improved, and the quantity of the sodium hydroxide used was reduced; and (2) it was unnecessary to dispose of the treatment liquid discharged externally of a system, which had been disposed of as an industrial waste hitherto the invention, and the quality of aluminum hydroxide slag discharged in the respective surface treatment processes was changed into an industrially useful form of aluminum hydroxide. Thus, the manufacturing cost was greatly reduced.

Figure 3:
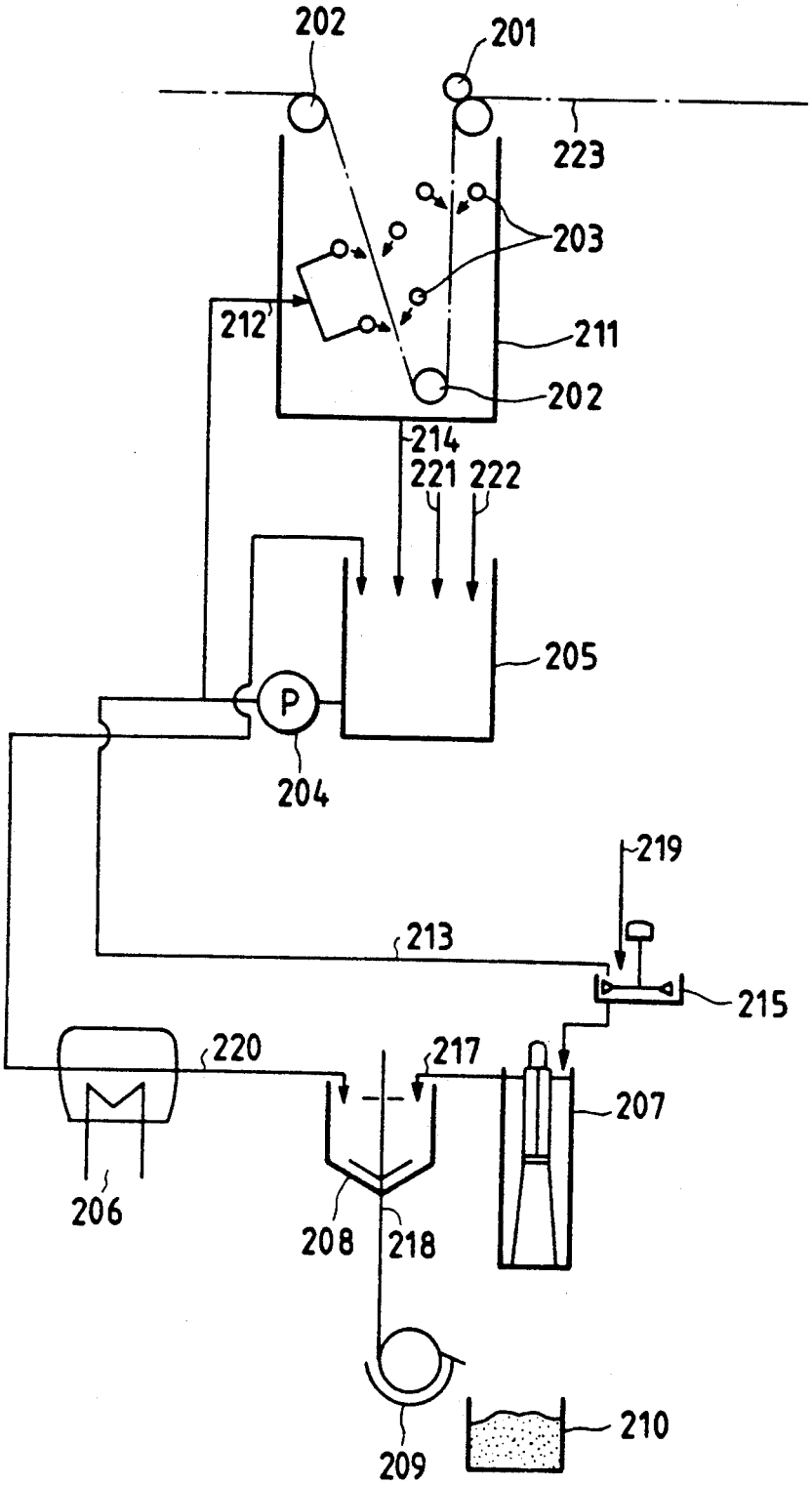
FIG. 3 shows schematically the configuration of an apparatus for performing etching treatment according to a second embodiment of the present invention.

A second embodiment of the present invention will be described with reference to FIG. 3. FIG. 3 is a schematic configuration of an apparatus for performing surface treatment of an aluminum plate according to the second embodiment of the present invention.

In an etching treatment process, a treatment liquid is mixed in a liquid control tank 205, and the mixed treatment liquid is fed to a spray pipe 203 in an etching treatment tank 211 through a liquid feed pipe 212 by using a liquid feed pump 204. The etching treatment liquid from the liquid control tank 205 may also be fed to a dissolution tank through a liquid feed pipe 213 branching off from the liquid feed pipe 212. The quantity and feeding time of the fed liquid can be controlled by the operation of valves (not shown in FIG. 3) provided in line with the pipe arrangements.

The liquid control tank 205 and the etching treatment tank 211 are interconnected through the liquid feed pipe 212 and a return liquid pipe 214, and the etching treatment liquid is circulated among them. Through the etching treatment, the quantity and component concentration of the treatment liquid is changed. For example, a sodium hydroxide component in the treatment liquid decreases by reaction, the quantity of an aluminum ion component increases, water decreases by evaporation, and so on. Therefore, the sodium hydroxide solution and water used in the treatment liquid are replenished to the treatment liquid control tank 205 through make-up or replenishing pipes 221 and 222, respectively. However, it is not very effective to maintain the aluminum ions in the treatment liquid to a predetermined value by using a make-up liquid without also eliminating the increase of aluminum ions.

Therefore, a portion of the liquid which is being used while being circulated in the liquid control tank 205 is fed to the dissolution tank 215 through the liquid feed pipe 213 occasionally so that aluminum ions are discharged externally of the system.

In the dissolution tank 215, the etching treatment liquid and, if necessary, water are added and mixed, so that a hydrolytic reaction is generated, and the liquid is fed to a precipitation tank 207 occasionally.

In the precipitation tank 207, the aluminum hydroxide is crystallized using a seed of aluminum hydroxide in the sodium aluminate solution as a nucleus.

Therefore, the mixture of the treatment liquid mainly including a sodium hydroxide solution having a reduced concentration of aluminum ions and the crystals of aluminum hydroxide are fed to a thickener 208 through a liquid feed pipe 217, and the crystallized aluminum hydroxide is separated in a drum filter 209 through a pipe 218, and collected into a hopper 210. On the other hand, the treatment liquid mainly including a sodium hydroxide solution is returned, as a recovered liquid, to the liquid control tank 205 through a recovery pipe 220. In this case, the recovered liquid may be condensed partially through an evaporation pipe and returned to the liquid control tank 205.

According to the apparatus of the second embodiment having the above-mentioned arrangement, the quantity of the treatment liquid used per unit time when performing etching treatment on the surface of an aluminum plate was measured while the treatment liquid was recovered under the following conditions:

| | |
|---|---|
| aluminum plate width | 1000 mm |
| treatment speed | 50 meters/minute |
| treatment liquid: | |
| sodium hydroxide | 300 grams/liter |
| aluminum ions | 75 grams/liter |
| temperature | 60° C. |

The quantity of the sodium hydroxide solution recovered from the make-up pipe 222 was 60 kilograms/hour 20 grams/square meter).

The time required for the crystal separation reaction in the precipitation tank 7 was about 60 hours, and the aluminum hydroxide obtained by the crystallization had the following qualities:

| | |
|---|---|
| iron component | 360 mg/kg |
| silicon dioxide | 50 mg/kg |
| $COD_{Cr}$ | 540 mgo/kg |
| content of water | 11.4% |
| color | light brown |

COMPARATIVE EXAMPLE NO. 2

Similarly to the conventional methods, an etching treatment was performed on the surface of an aluminum plate by a method being externally controlled to maintain the concentration of aluminum ions constant while omitting the processes subsequent to the solution tank, and discharging a portion of the surface treatment liquid externally of the system. Other conditions were the same as in the second embodiment described above.

The quantity of sodium hydroxide solution used per unit time was increased to 240 kilograms/hour (80 grams/square meter). Additionally, treating the surface treatment liquid discharged externally of the system by neutralization or the like was required.

According to the surface treatment method according to the second embodiment of the present invention:

(1) the efficiency or one treatment liquid used for surface treatment was improved, and the quantity of sodium hydroxide used was reduced; and (2) selling and using aluminum hydroxide, as an industrial product, obtained from a treatment liquid discharged externally of a system has become possible as a result of the present invention. Thus, the above-described method has contributed greatly to reducing system costs.

Figure 4:
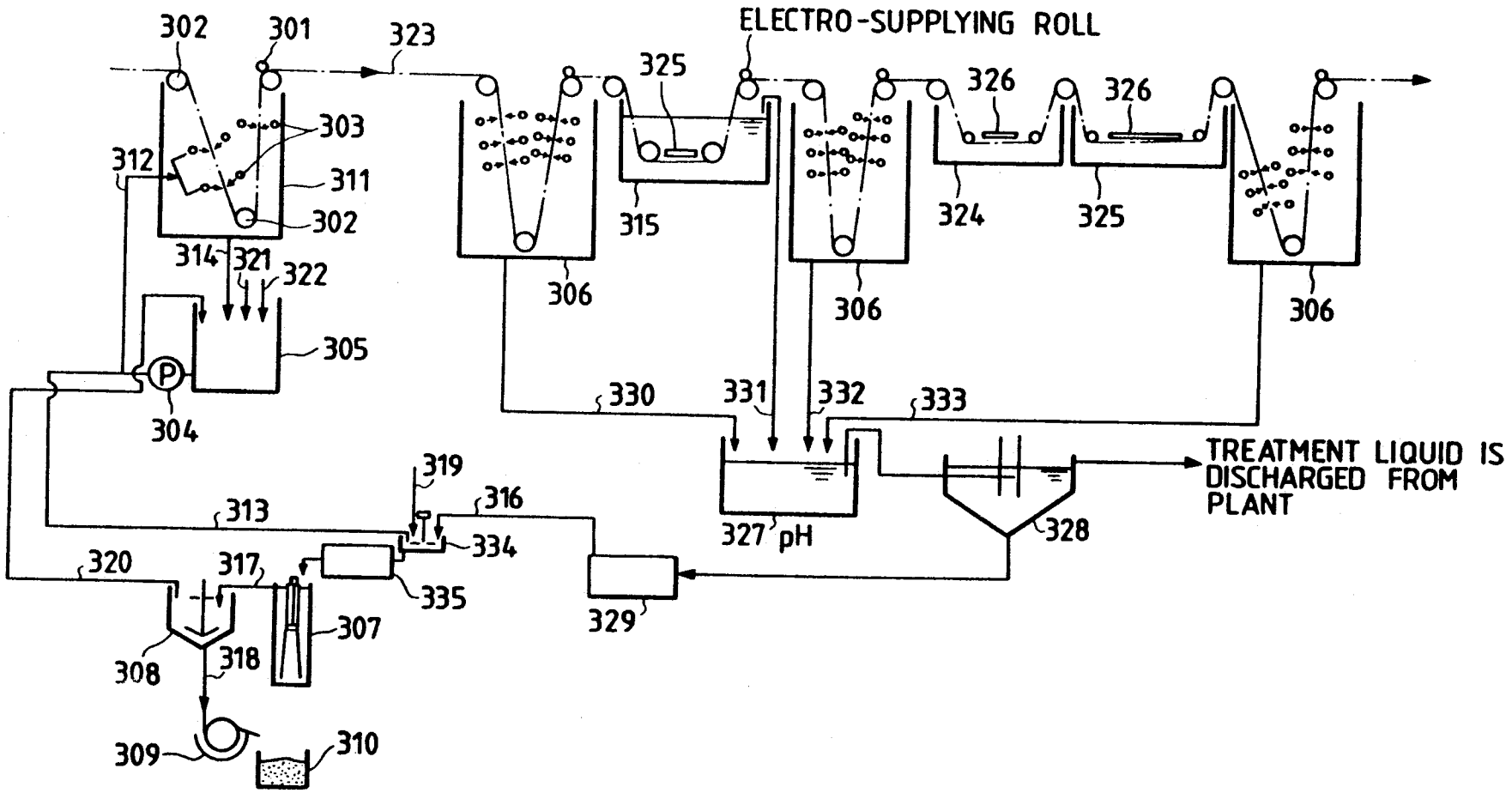
FIG. 4 shows schematically the configuration of an apparatus for performing etching treatment according to a third embodiment of the treatment method of the present invention.
Figure 5:
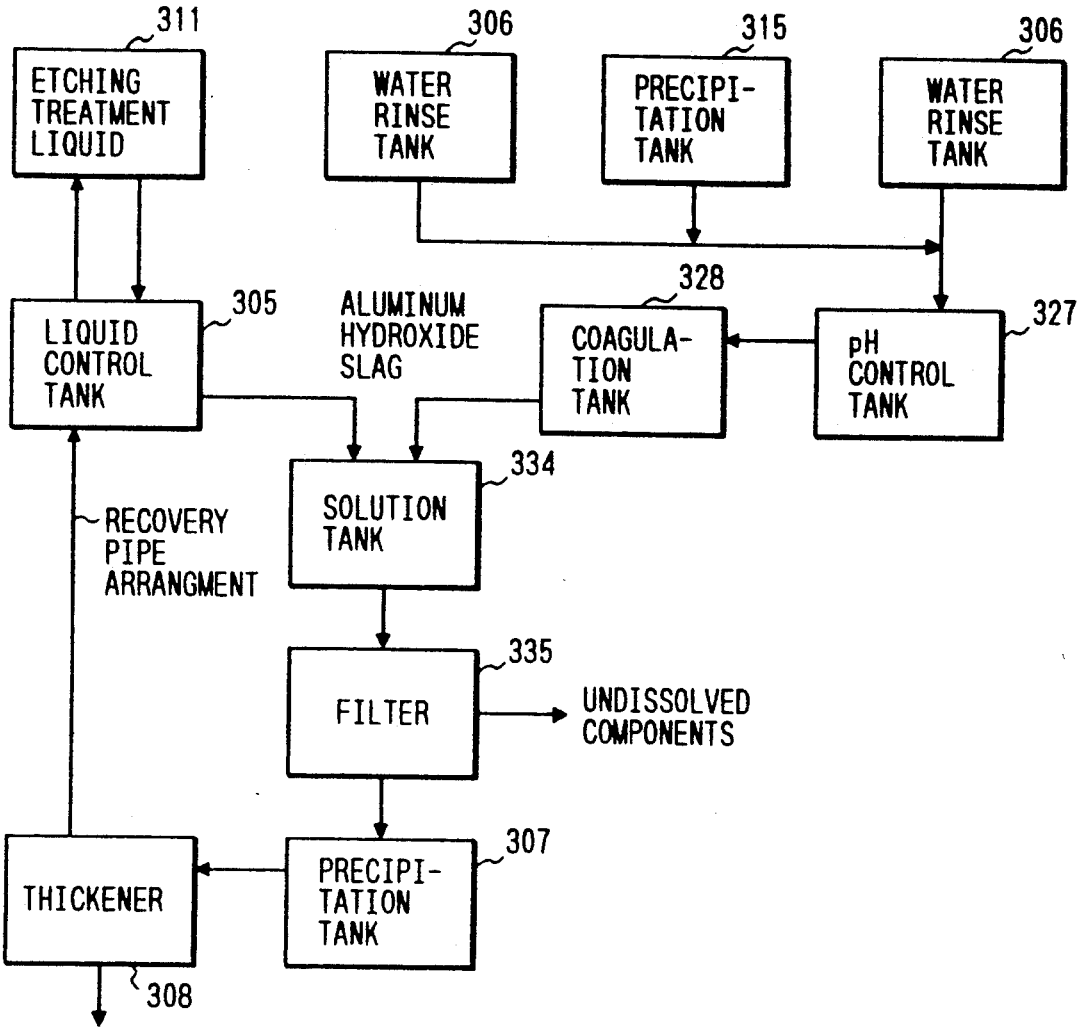
FIG. 5 is a flow diagram of the schematic configuration shown in FIG. 4.

A third embodiment of the present invention will be described with reference to FIGS. 4 and 5. FIGS. 4 and 5 are a schematic configuration diagram and a flow diagram, respectively, of an apparatus for performing surface treatment of an aluminum plate according to a third embodiment of the present invention.

In an etching treatment, by performing a surface treatment process similarly to the above-described first embodiment, a portion of treatment liquid used while being circulated in the liquid control tank 305 is fed to the dissolution tank 334 occasionally, and aluminum ions are discharged externally of the system. On the other hand, a waste alkali 330 and a waste acid 331–333 discharged in the respective surface treatment processes are neutralized in a pH control tank 327 so that aluminum slag 316 is coagulated in a coagulation tank 328. Additionally, after solid and liquid phase components are separated from each other in a filter press 329, the aluminum slag 316 is fed to the dissolution tank 334 occasionally.

In the dissolution tank 334, the etching treatment liquid and the aluminum slag 316 are mixed and formed into a supersaturated sodium aluminate solution. The liquid thus formed is passed through a filter 335 to eliminate undissolved components, and fed to a precipitation tank 307 occasionally.

In the precipitation tank 307, the aluminum hydroxide is crystallized using a seed of aluminum hydroxide in the supersaturated sodium aluminate solution as a nucleus.

Therefore, the mixture of the treatment liquid mainly including a sodium hydroxide solution having a reduced concentration of aluminum ions and containing crystals of aluminum hydroxide is fed to a thickener 308 through a liquid feed pipe 317, and the crystallized aluminum hydroxide is separated in a drum filter 309 through a pipe 318, and collected into a hopper 310. On the other hand, the treatment liquid mainly including a sodium hydroxide solution is returned, as a recovered liquid, to the liquid control tank through a recovery pipe 320.

According to the apparatus having the above-described arrangement shown in FIG. 4, the quantity of the treatment liquid used per unit time when performing an etching treatment on the surface of an aluminum plate was measured while the treatment liquid was recovered under the following conditions (which were the same as those described above in the first embodiment):

| | |
|---|---|
| aluminum plate width | 1000 mm |
| treatment speed | 50 meters/minute |
| treatment liquid: | |
| sodium hydroxide | 300 grams/liter |
| aluminum ions | 75 gram/liter |
| temperature | 60° C. |

The quantity of the sodium hydroxide solution recovered from the make-up pipe 322 was 60 kilograms/hour (20 gram/square meter).

The time required for the crystallizing reaction in the precipitation tank 307 at this time was about 14 hours, and the aluminum hydroxide obtained by the crystallization had the qualities listed below. For the sake of comparison, the quality of the aluminum hydroxide in the first embodiment is also shown.

| | 3rd Embodiment | 1st Embodiment |
|---|---|---|
| iron component | 36 mg/kg | 360 mg/kg |
| silicon dioxide | 30 mg/kg | 50 mg/kg |
| $COD_{Cr}$ | 110 mgo/kg | 540 mgo/kg |
| content of water | 11.3% | 11.4% |
| color | white | light brown |

The quality of the aluminum hydroxide obtained in the above-mentioned third embodiment was superior to that of the aluminum hydroxide obtained in the first embodiment, so that it is understood that preferably a supersaturated sodium aluminate solution is passed through a filter to thereby remove undissolved components, and then the resulting solution is crystallized in a precipitation tank.

With a surface treatment method according to the third embodiment of the present invention:

(1) the efficiency of the treatment liquid used for surface treatment was improved, and the quantity of the sodium hydroxide used was reduced; and (2) it was unnecessary to dispose of the treatment liquid discharged externally of the system, which had conventionally been disposed of as an industrial waste, and it was possible to improve the quality of aluminum hydroxide slag discharged in the respective surface treatment processes into an industrially available and useful aluminum hydroxide which could be sold as aluminum hydroxide industrial products.

Additionally, through mixing an etching treatment liquid with the aluminum slag, adjusting a supersaturated sodium aluminate solution, and passing this adjusted solution through a filter to thereby remove undissolved components the following advantages were achieved:

(3) the time for the crystallizing reaction was shortened to ¼ of that used previously;

(4) the capacity of the precipitation tank could be reduced to ¼ of that used previously because of the reduction of the staying time for crystallization; and (5) the iron component of the aluminum hydroxide obtained by the crystallization became 1/10, the high molecular component thereof became not more than 1/5, and the color thereof became white. Thus, the manufacturing cost could be decreased over that of the conventional systems.

Figure 6:
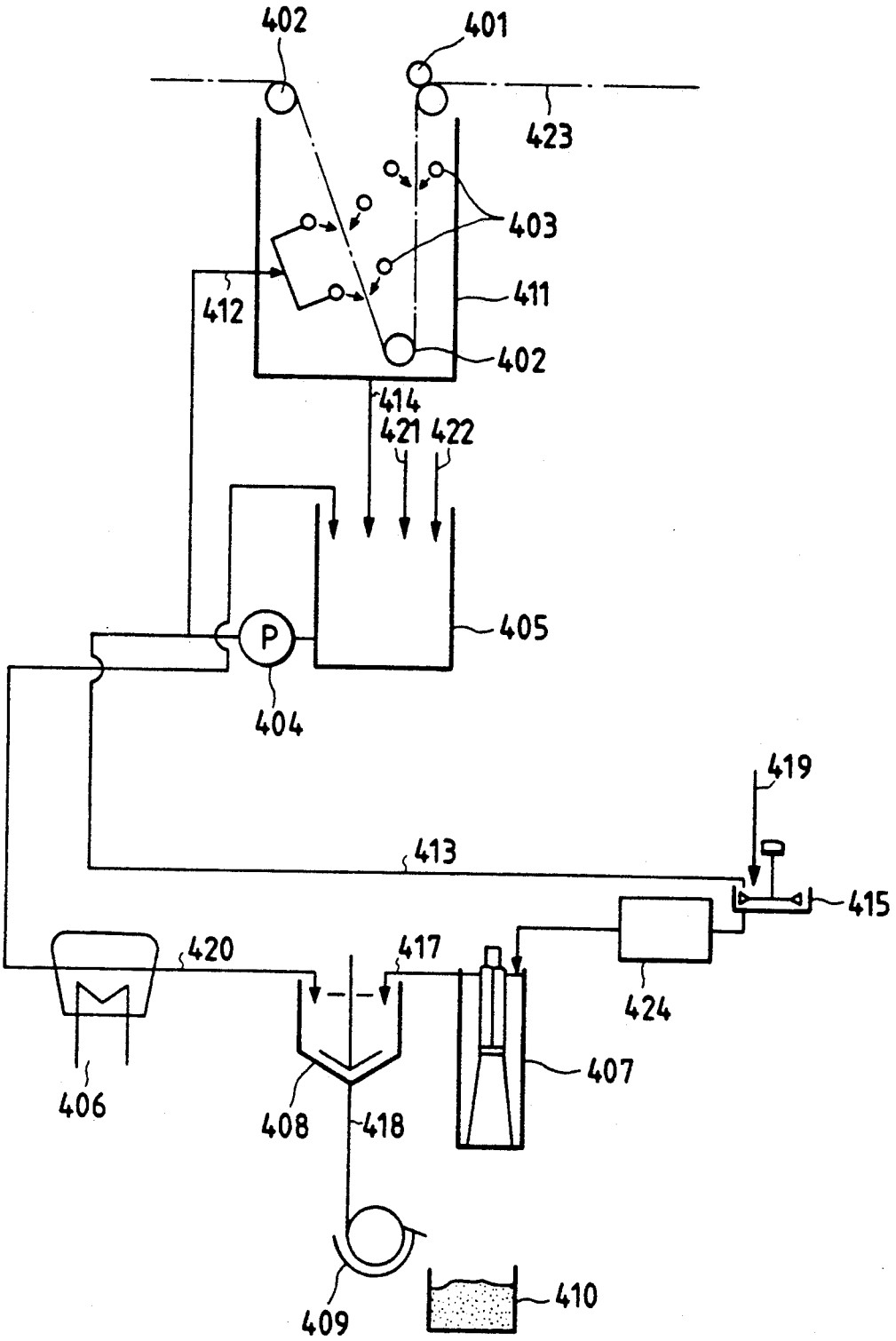
FIG. 6 shows schematically the configuration of an apparatus for performing etching treatment according to a fourth embodiment of the present invention.

A fourth embodiment of the present invention will be described with reference to FIG. 6. FIG. 6 is a schematic configuration diagram of an apparatus for performing surface treatment of an aluminum plate according to the fourth embodiment of the present invention. The treatment method for the apparatus shown in FIG. 6 is similar to that of the above-mentioned second embodiment, but differs from the apparatus shown in FIG. 3 by the addition of a filter 424 provided in-line of a pipe arrangement for feeding treatment liquid from a dissolution tank 415 to a precipitation tank 407.

That is, in the etching treatment, a mixed treatment liquid in a liquid control tank 405 is fed partially to a dissolution tank 415 occasionally to discharge aluminum ions externally of a system. Additionally, in the dissolution tank 415, an etching treatment liquid and, if necessary, water are added and mixed. Thereafter, undissolved components such as ferric hydroxide is removed through a filter, and the liquid is fed occasionally to a precipitation tank 407.

In the precipitation tank 407, a hydrolytic reaction is produced by using a seed of aluminum hydroxide in the supersaturated sodium aluminate solution as a nucleus, so that the aluminum hydroxide is crystallized.

Thereafter, dealing with the mixture of crystals of the aluminum hydroxide crystals and the treatment liquid mainly including a sodium hydroxide having a lowered aluminum ion concentration is the same as that of the second embodiment.

According to the apparatus of FIG. 6, the quantity of the treatment liquid used per unit time when performing the etching treatment on the surface of an aluminum plate was measured while the treatment liquid was recovered under the following conditions:

| | |
|---|---|
| aluminum plate width | 1000 mm |
| treatment speed | 50 meters/minute |
| treatment liquid: | |
| sodium hydroxide | 300 grams/liter |
| aluminum ions | 75 grams/liter |
| temperature | 60° C. |

The quantity of the sodium hydroxide solution recovered from the make-up pipe 422 was 60 kilograms/hour (20 grams/square meter).

The time required for the crystallizing reaction in the precipitation tank 407 at this time was about 14 hours, and the aluminum hydroxide obtained by the crystallization had the qualities below. For purposes of comparison, the characteristics of the aluminum hydroxide in the second embodiment are also shown.

| | 4th Embodiment | 2nd Embodiment |
|---|---|---|
| iron component | 34 mg/kg | 360 mg/kg |
| silicon dioxide | 30 mg/kg | 40 mg/kg |
| $COD_{Cr}$ | 100 mgo/kg | 110 mgo/kg |
| content of water | 11.2% | 11.3% |
| color | white | light brown |

The quality of the aluminum hydroxide obtained in the above-mentioned fourth embodiment was superior to that of the aluminum hydroxide obtained in the second embodiment, so that it is understood that preferably a supersaturated sodium aluminate solution is passed through a filter to thereby remove undissolved components, and then the resulting solution is crystallized in a precipitation tank.

Thus, according to a surface treatment method for the present invention:

(1) the efficient use of the treatment liquid employed for surface treatment was improved, and the quantity of sodium hydroxide used was reduced, and (2) it became possible to sell the aluminum hydroxide (as an industrial product) recovered from a treatment liquid and discharged externally of a system.

Additionally, by adding water to the etching treatment liquid as required, adjusting a supersaturated sodium aluminate solution, and passing this adjusted solution through a filter to thereby remove undissolved components:

(3) it was possible to shorten the crystallizing reaction time to ¼;

(4) it became possible to reduce the precipitation tank capacity by ¼ because of the reduction of the staying time for the crystallization process time; and (5) the iron component of the aluminum hydroxide obtained by crystallization became 1/10 and the color thereof became white.

While certain preferred embodiments have been shown and described above, many changes and modifications within the spirit of the invention will be apparent to those of working skill in this technical field. Thus, the scope of the invention should be considered as limited only by the appended claims.

What is claimed is:

1. A method for treating a surface of an aluminum substrate for a printing plate adapted for use with a treatment liquid including aluminum ions being circulated in a treatment system, comprising:

treating a surface of said substrate with a treatment liquid;

separating and discharging externally of said system aluminum ions from a portion of said treatment liquid used while being circulated, said treatment liquid including a sodium aluminate solution;

recovering a sodium hydroxide solution from said treatment liquid;

mixing the recovered sodium hydroxide solution with the treatment liquid to be subsequently used;

maintaining a predetermined concentration of aluminum ions in said treatment liquid, wherein a waste acid and a waste alkali are discharged during said treating step; and neutralizing said waste acid and said waste alkali discharged during said treating step, wherein an aluminum slag including an amorphous aluminum hydroxide is produced at the time of said neutralizing step, and wherein said aluminum slag is mixed with a portion of the treatment liquid to be subsequently used including the sodium aluminate solution being circulated thereby supersaturating the sodium aluminate solution, crystallizing the aluminum hydroxide, and enabling the sodium hydroxide solution to be reused.

2. The method according to claim 1, wherein said amorphous aluminum hydroxide is a main component of said aluminum slag.

3. The method according to claim 1, further comprising providing a pH control tank and a coagulation tank, wherein said waste alkali and said waste acid discharged through said treating step are neutralized in a pH control tank and said aluminum slag subsequently coagulates in a coagulation tank.

4. The method according to claim 1, further comprising a filter press and a dissolution tank, wherein said aluminum slag includes a solid and a liquid component, said solid and liquid components being separated in said filter press, wherein after the solid and liquid components are separated, a predetermined quantity of said aluminum slag is fed to said dissolution tank at a predetermined time.

5. The method according to claim 1, wherein said aluminum hydroxide is crystallized by using a seed of said aluminum hydroxide in the supersaturated sodium aluminate solution as a nucleus.

6. The method according to claim 1, further comprising providing a dissolution tank, wherein a portion of said treatment liquid used while being circulated is fed to a dissolution tank at a predetermined time such that a predetermined quantity of said aluminum ions are discharged externally of the system.

7. The method according to claim 1, further comprising:

providing a liquid control tank for storing said treatment liquid;

mixing said aluminum slag and a portion of said treatment liquid from said liquid control tank into said supersaturated sodium aluminate solution;

feeding said supersaturated sodium aluminate solution to a precipitation tank, said aluminum hydroxide being crystallized in said precipitation tank; and feeding a mixture of said treatment liquid from said dissolution tank and crystals of aluminum hydroxide from said precipitation tank to a thickener.

8. The method according to claim 7, wherein said crystals of aluminum hydroxide are separated from said treatment liquid in a drum filter, and said crystals of aluminum hydroxide are collected in a hopper.

9. The method according to claim 8, wherein said treatment liquid mainly including a sodium hydroxide solution is returned to said liquid control tank from said thickener.

10. The method according to claim 1, further comprising providing a filter, and conveying said supersaturated aluminate solution through said filter to remove undissolved components therefrom to enable the sodium hydroxide solution to be reused.

11. A method for treating a surface of an aluminum substrate for a printing plate adapted for use with a treatment system, comprising:

treating said surface of said aluminum substrate with a treatment liquid;

separating and discharging externally of said system aluminum ions from a portion of said treatment liquid including a sodium aluminate solution used while being circulated for said treating step;

recovering a sodium hydroxide solution from said treatment liquid used in said treating step;

mixing the recovered sodium hydroxide with the treatment liquid used while being circulated; and maintaining a predetermined concentration of aluminum ions in said treatment liquid, wherein a hydrolytic reaction is caused by one of said portion of the treatment liquid containing the sodium aluminate solution used while being circulated being mixed with a predetermined quantity of water, and said portion of the treatment liquid including the sodium aluminate solution used while being circulated being extracted, so that aluminum hydroxide is crystallized from the sodium aluminate solution and simultaneously the sodium hydroxide solution is recovered to be reused.

12. The method according to claim 11, further comprising providing a liquid control tank in which said treatment liquid is stored and circulated for use and a dissolution tank, wherein a predetermined quantity of said treatment liquid being circulated in said liquid control tank is fed to said dissolution tank at a predetermined time such that said aluminum ions are discharged externally of the system.

13. The method according to claim 11, further comprising providing a precipitation tank, wherein when said treatment liquid and water are mixed to produce said hydrolytic reaction a predetermined quantity of a resulting liquid is fed to said precipitation tank at a predetermined time.

14. The method according to claim 11, wherein said aluminum hydroxide is crystallized by using a seed of aluminum hydroxide in the sodium aluminate solution as a nucleus.

15. The method according to claim 12, further comprising providing a thickener, wherein a mixture of said treatment liquid from said liquid control tank including a sodium hydroxide solution having a predetermined concentration of aluminum ions, and crystals of aluminum hydroxide from said precipitation tank are fed to said thickener.

16. The method according to claim 15, further comprising providing a drum filter and a hopper, wherein said crystals of aluminum hydroxide are separated from said sodium hydroxide solution in said drum filter, and subsequently collected in said hopper.

17. The method according to claim 16, further comprising said treatment liquid mainly including said sodium hydroxide solution being returned to said liquid control tank.

18. The method according to claim 17, wherein said treatment liquid is partially condensed through an evaporation pipe and returned to said liquid control tank.

19. A method for treating a surface of an aluminum substrate for a printing plate, comprising:

treating said aluminum substrate with a treatment liquid being circulated, said treatment liquid including a sodium aluminate solution;

separating and discharging externally of a system aluminum ions from a portion of said treatment liquid containing said sodium aluminate solution used while being circulated for said treating step;

recovering a sodium hydroxide solution from said treatment liquid;

mixing the recovered sodium hydroxide with the treatment liquid being circulated; and maintaining a predetermined concentration of aluminum ions in said treatment liquid, wherein said separating step is performed by one of mixing said portion of said treatment liquid containing said sodium aluminate solution with water, and extracting said portion of said treatment liquid containing said sodium aluminate solution used while being circulated, and wherein a hydrolytic reaction is produced in the treatment liquid having been separated from said aluminum ions, so that the aluminum hydroxide is crystallized from the sodium aluminate solution and simultaneously the sodium hydroxide solution is recovered to be reused.

20. A method for treating a surface of an aluminum substrate for a printing plate, comprising:

treating said aluminum substrate with a treatment liquid including a sodium aluminate solution;

separating and discharging externally of a system aluminum ions from a portion of said treatment liquid containing said sodium aluminate solution used while being circulated for said treating step;

recovering a sodium hydroxide solution from said treatment liquid used in said treating step;

mixing the recovered sodium hydroxide with the treatment liquid used while being circulated; and maintaining a predetermined concentration of said aluminum ions in said treatment, said separating step comprises one of mixing said portion of said treatment liquid containing said sodium aluminate solution used while being circulated with water, and extracting a portion of said treatment liquid containing said sodium aluminate solution used while being circulated, wherein the treatment liquid separated from said aluminum ions is conveyed through a filter, and wherein a hydrolytic reaction is produced so that the aluminum hydroxide is crystallized from the sodium aluminate solution and simultaneously the sodium hydroxide solution is recovered to be reused.

21. An apparatus for treating a surface of an aluminum plate for a printing plate adapted for use with a treatment liquid including aluminum ions being circulated, comprising:

means for treating a surface of said substrate with said treatment liquid, said treatment liquid including a sodium aluminate solution;

means for separating and discharging externally of said system aluminum ions from a portion of said treatment liquid including said sodium aluminate solution used while being circulated to treat said surface;

means for recovering a sodium hydroxide solution from said treatment liquid;

means for mixing the recovered sodium hydroxide solution with the treatment liquid used while being circulated;

means for maintaining a concentration of aluminum ions in said treatment liquid at a predetermined value, wherein a waste acid and a waste alkali are produced by treating said surface of said aluminum substrate; and means for neutralizing said waste acid and said waste alkali discharged during treating of said surface, wherein an aluminum slag including an amorphous aluminum hydroxide is produced during neutralizing of said waste acid and said waste alkali; and means for mixing said aluminum slag with a portion of the treatment liquid to be subsequently used including the sodium aluminate solution being circulated thereby supersaturating the sodium aluminate solution, crystallizing the aluminum hydroxide, and enabling the sodium hydroxide solution to be reused.

22. The apparatus according to claim 21, further comprising a filter through which said supersaturated aluminate solution is conveyed to remove undissolved components from said supersaturated aluminate solution to enable the sodium hydroxide solution to be reused.

23. An apparatus for treating a surface of an aluminum substrate for a printing plate, comprising:

means for treating said surface of said aluminum substrate with a treatment liquid, said treatment liquid including a sodium aluminate solution;

means for separating and discharging externally aluminum ions from a portion of said treatment liquid including said sodium aluminate solution used while being circulated;

means for recovering a sodium hydroxide solution from said treatment liquid used in treating said surface of said aluminum substrate;

means for mixing the recovered sodium hydroxide with the treatment liquid used while being circulated;

means for maintaining a predetermined concentration of aluminum ions in said treatment liquid, wherein said separating means comprises one of means for mixing a portion of the treatment liquid containing the sodium aluminate solution used while being circulated with water, and means for extracting a portion of the treatment liquid including the sodium aluminate solution used while being circulated; and means for producing a hydrolytic reaction such that aluminum hydroxide is crystallized from the sodium aluminate solution and simultaneously the sodium hydroxide solution is recovered to be reused.

24. An apparatus according to claim 23, further comprising a filter through which the treatment liquid having been separated is conveyed.

* * * * *